US007975658B2

(12) United States Patent
Pingel et al.

(10) Patent No.: US 7,975,658 B2
(45) Date of Patent: Jul. 12, 2011

(54) AIR PORT AND SMELT SPOUT CLEANER AND DROP JAW TIP

(75) Inventors: Kenneth A Pingel, Beaverton, OR (US); Michael deSousa, Beaverton, OR (US)

(73) Assignee: Clyde Bergemann, Inc., Beaverton, OR (US)

( * ) Notice: Subject to any disclaimer, the term of this patent is extended or adjusted under 35 U.S.C. 154(b) by 1936 days.

(21) Appl. No.: 10/435,437

(22) Filed: May 9, 2003

(65) Prior Publication Data

US 2003/0217706 A1 Nov. 27, 2003

Related U.S. Application Data

(60) Provisional application No. 60/379,538, filed on May 9, 2002.

(51) Int. Cl.
*F23L 5/00* (2006.01)
*F22B 37/48* (2006.01)

(52) U.S. Cl. ..... 122/379; 110/182.5

(58) Field of Classification Search ..... 110/182.5, 110/163; 122/379; 15/243, 104.18
See application file for complete search history.

(56) References Cited

U.S. PATENT DOCUMENTS

| | | | | | |
|---|---|---|---|---|---|
| 547,451 | A | * | 10/1895 | Radspinner | 15/104.18 |
| 1,033,653 | A | * | 7/1912 | Ashton | 15/104.18 |
| 1,191,236 | A | * | 7/1916 | Rigo | 15/104.18 |
| 1,262,755 | A | * | 4/1918 | Cutter | 15/104.16 |
| 4,333,200 | A | * | 6/1982 | Thurow | 15/104.69 |
| 4,538,552 | A | * | 9/1985 | Smuda | 122/387 |
| 4,653,409 | A | * | 3/1987 | Eriksson | 110/182.5 |
| 5,167,192 | A | * | 12/1992 | Pingel et al. | 110/182.5 |
| 5,351,631 | A | * | 10/1994 | Hill et al. | 110/182.5 |

* cited by examiner

*Primary Examiner* — Steven B McAllister
*Assistant Examiner* — Nikhil Mashruwala
(74) *Attorney, Agent, or Firm* — patenttm.us

(57) ABSTRACT

An air port or smelt spout cleaning tip presents a wider cleaning area configuration on an insertion phase, and on retraction, the tip collapses to provide a smaller size to prevent against hanging up on adjacent structures.

15 Claims, 6 Drawing Sheets

PENETRATING STROKE

TIP IS LOCKED INTO CLEANING POSITION

Working Principles R-M

Damper Concept Not Valid

*Rodding Master horn is throttled within the port casting volute to provide a port damping capability.*

*This is not valid as airflow goes both around and inside the opening.*

AIR PORT AND SMELT SPOUT CLEANER AND DROP JAW TIP

BACKGROUND OF THE INVENTION

This invention relates to cleaning of air ports and smelt spouts in recovery boilers.

In operation of recovery boilers, it is necessary to clean the air ports of build up material that collects and, over time, obstructs the air ports. One style of known port cleaner employs a "cookie cutter" type operation, wherein a fixed size and shape punch is periodically moved into the air port in an attempt to break away any built up material. This type device travels through a single fixed actuation path.

However, over time, bushings will wear, which alters the exact operation path through which the punch will move. This can result in the punch getting caught on the port, for example, An example of a prior art device is illustrated schematically in FIG. 1 and FIG. 2. In FIG. 1, which is a top sectional view of an installation of the prior art device, a wind box 10 is provided on the outside wall of the recover boiler tubes 12. Several air ports 14 enable entry of combustion air 16 (which is supplied to the wind box by means not shown) into the boiler interior. The prior art device employs a ring-shaped gap area 18 around the air ports, which are able receive hollow sleeves 20 therein. The sleeves are mounted to a compression air cylinder 22, which is actuable to cause the sleeves to translate into and out of the air ports on an insertion stroke. The sleeves are in the retracted state in FIG. 1 and are in the inserted state in FIG. 2. The hollow sleeve allows entry of air therethrough into the air port.

The tip portion of the sleeve comprises a horn that enters into the airport is shaped similar to the shape of the airport opening, but is slightly smaller. The outside perimeter of the horn acts to clean the air port by entry into the air port, and thereby scraping or knocking off built up material. An attempt to provide damping (i.e. some air flow control) is made by throttling the horn within the volute of the air port. However, the hollow nature of the sleeve and horn opening allows little actual flow control, as airflow will go around the opening between the sleeve and airport and through the hollow tube portion.

SUMMARY OF THE INVENTION

In accordance with the invention, an improved cleaning tip is provided that has a larger cleaning area on the penetrating or insertion stroke, but is of smaller area on the removal or retraction stroke. Further, a system for enhancing operation of prior art type cleaning devices is provided.

Accordingly, it is an object of the present invention to provide an improved cleaning tip for an air port cleaner.

It is a further object of the present invention to provide an improved cleaning tip that provides a larger cleaning area on insertion and a reduced area on retraction.

It is yet another object of the present invention to provide an improved system for cleaning air ports that is adapted for retrofitting to prior art type cleaning actuators.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

The system according to a preferred embodiment of the present invention comprises and air port cleaning system employing a drop tip jaw. On the inward portion of the cleaning stoke, where the cleaning tip is inserted into the air port, the tip expands to a wider configuration. On retraction, the tip collapses to provide a smaller size.

Figures 3, 4:
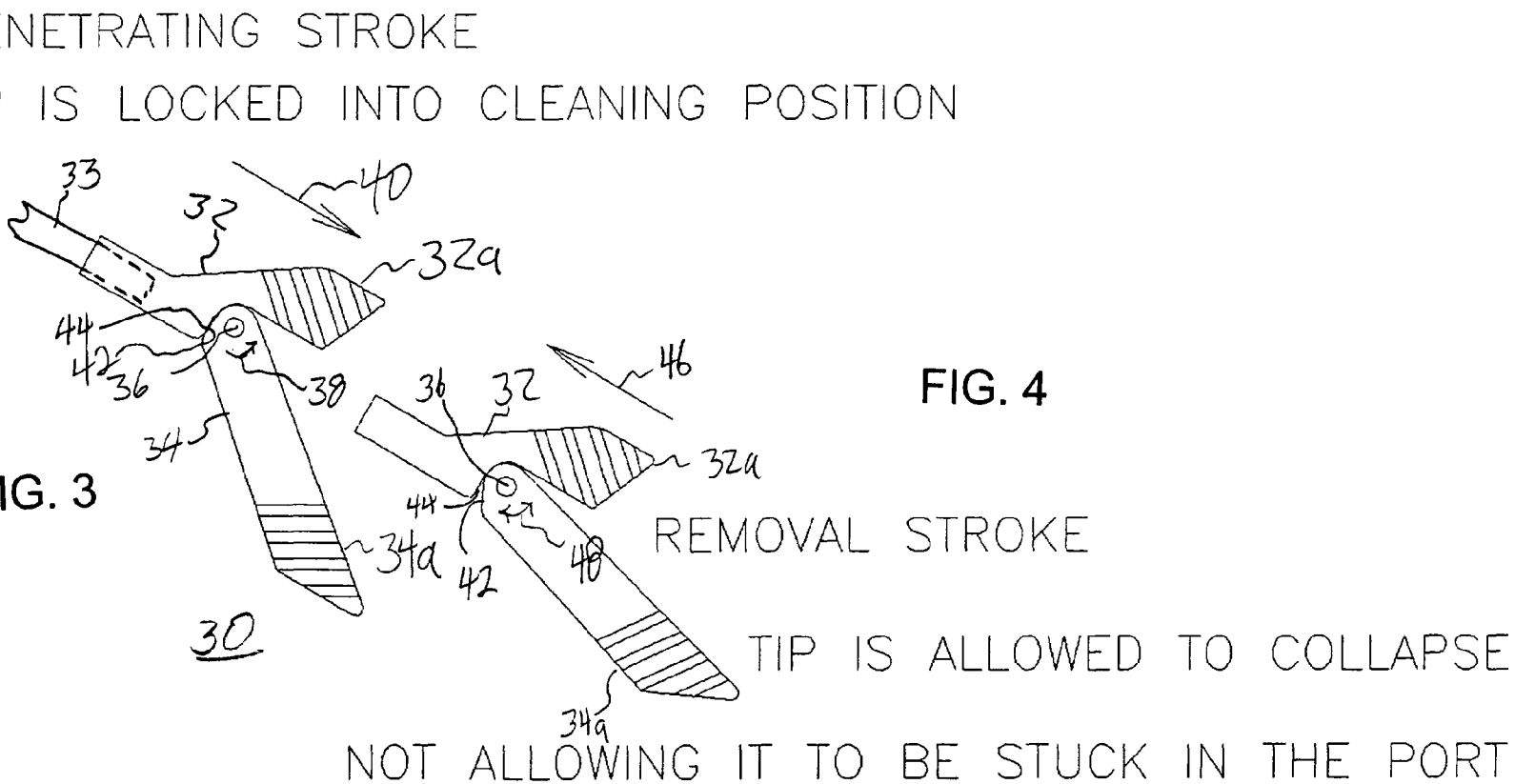
FIG. 3 is a side view of the drop jaw tip according to the present invention during a penetrating stroke.
FIG. 4 is a side view of the drop jaw tip according to the present invention during a removal stroke.

Referring to FIG. 3, a side view of the drop jaw tip according to the present invention during a penetrating stroke, the cleaning tip 30 comprises a base portion 32, which is adapted to mount to a support rod 33 device. The base portion includes a forward cleaning tip 32*a* which may have slots or serrations defined thereon. Pivotally mounted to base portion 32 at pivot point 36 is a movable cleaning tip portion 34, which is adapted to rotate forwardly as indicated by arrow 38. The portion 34*a* of the tip distal from pivot point 36 can include slots or serrations thereon.

In operation, the tip on a penetrating stroke is inserted to the air port, in the direction of arrow 40. The upper and lower portions 32*a* and 34*a* act to clean the air port. The swinging portion 34 includes an engaging portion 42 that seats against a corresponding portion 44 on the base 32, which locks the portion 34 against further rearward movement.

Referring now to FIG. 4, a side view of the drop jaw tip according to the present invention during a removal stroke, it may be observed that the removal in the direction of arrow 46 results in the tip portion 34 being able to move forwardly (or backwardly) about the pivot 36 as indicated by arrow 48. Thus, the tip "collapses" and is unlikely to become stuck in the air port.

Figures 5, 5A:
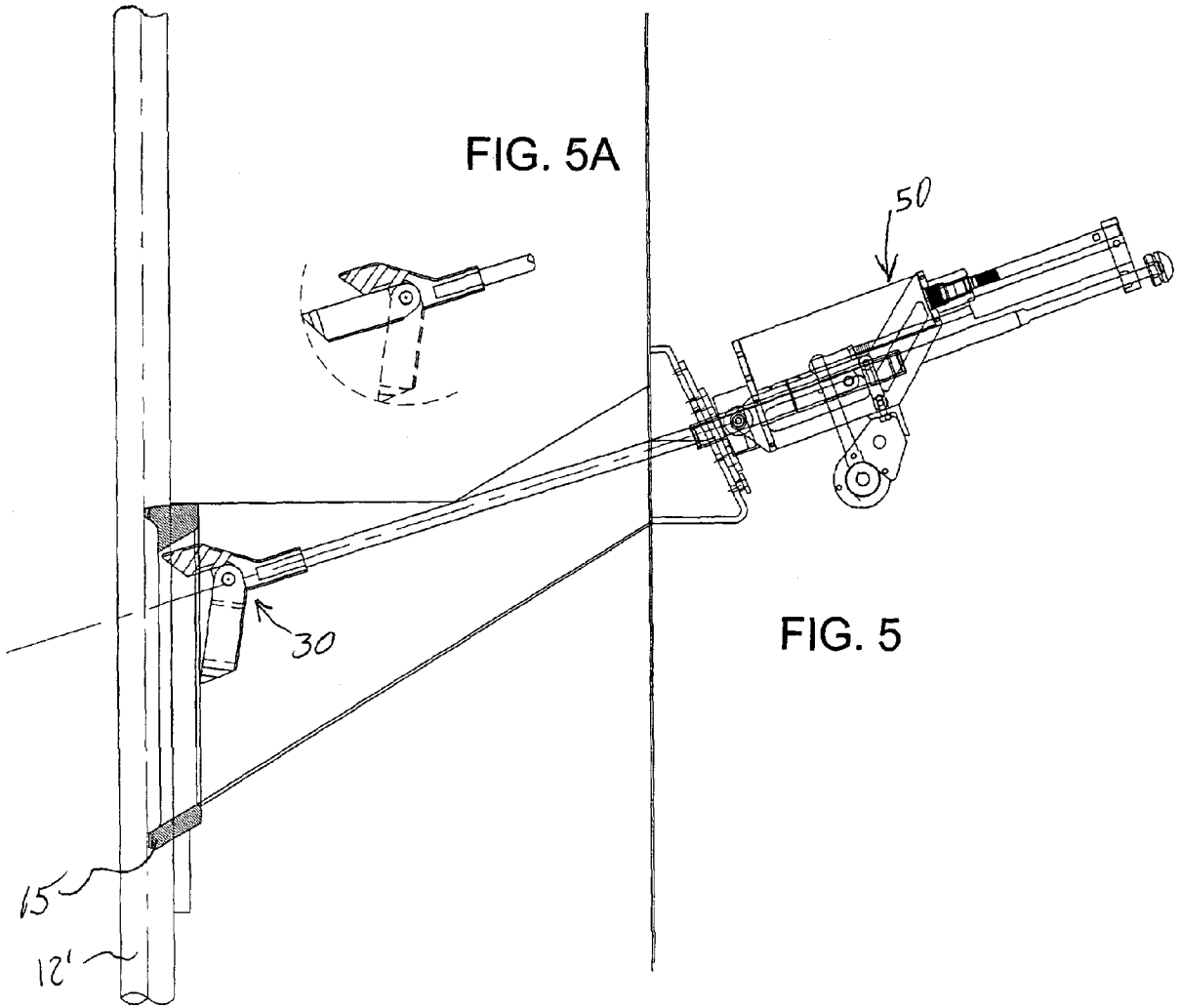
FIGS. 5, 5A comprise a cross sectional partially transparent view of a typical installation of the tip of FIGS. 3 and 4, 5A being detail of the tip.

FIG. 5 is a cross sectional partially transparent view of a typical installation of the tip of FIGS. 3 and 4. The recovery boiler wall 12' has an air port defined therein, which may include an airport casting 15 to further define the opening and to protect the tube wall from damage. A suitable airport casting is such as shown in U.S. Pat. No. 6,055,943, for example, the disclosure of which is incorporated herein by reference.

The drop jaw tip 30 is mounted to the end of an air port cleaner device which may comprise, for example, a device as described in U.S. Pat. No. 5,351,631, the disclosure of which is incorporated herein by reference. To clean the port, the cleaner device will extend the tip into and out of the air port, suitably indexing or otherwise moving around to ensure that the entire opening of the air port is cleaned. FIG. 5A shows in phantom the range of movement of the tip.

Figure 1:
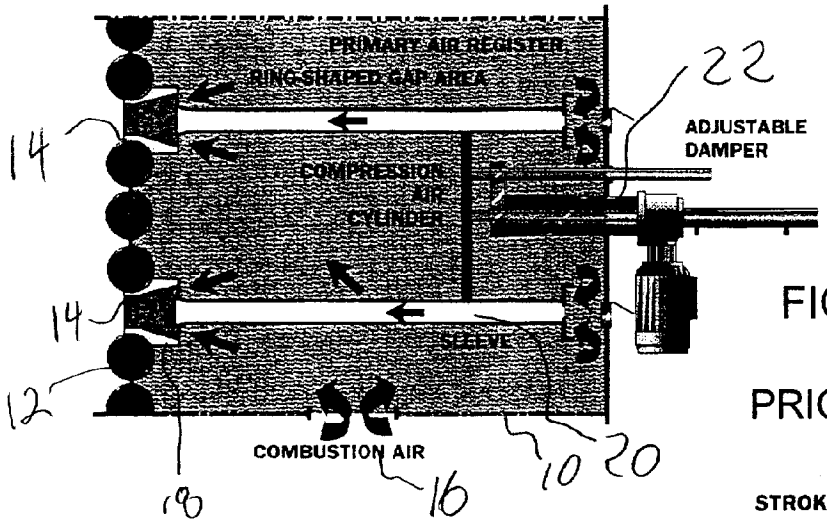
FIG. 1 PRIOR ART
FIG. 1 is an example of a prior art device in the retracted stage illustrated schematically.
Figure 2:
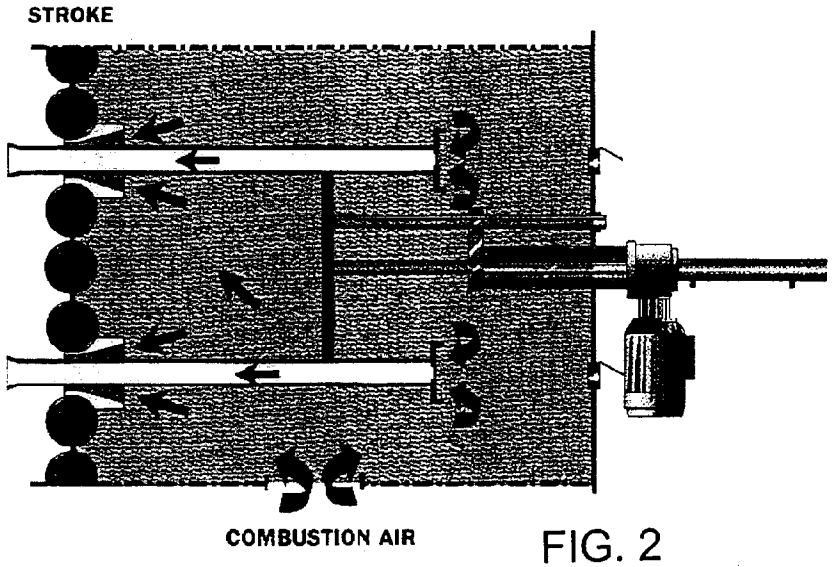
FIG. 2 PRIOR ART
FIG. 2 is an example of a prior art device in the inserted stage illustrated schematically.
Figure 6:
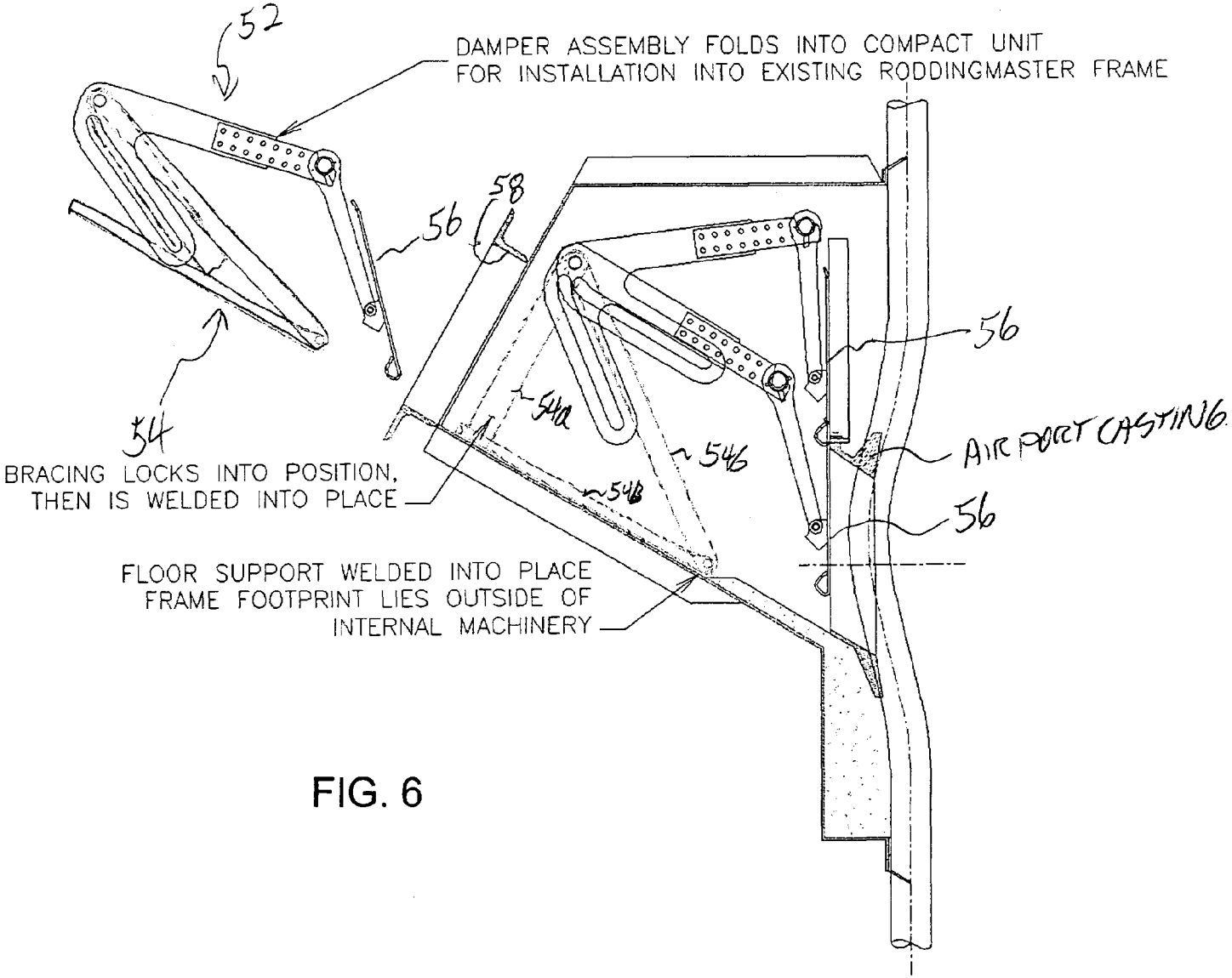
FIG. 6 is a side view of a damper assembly adapted for retrofitting the prior art with a damper and drop jaw tip cleaning device according to the invention.

Referring now to FIG. 6, a side view of a damper assembly adapted for retrofitting the prior art with a damper and drop jaw tip cleaning device according to the invention, a system for converting a prior art style air port cleaner as in FIG. 1, and FIG. 2 is shown. The particular device illustrated as being converted is a type of device sold by Kvaerner of Sweden under the trade name Roddingmaster. In FIG. 6, the driving system and controls have been removed in preparation for the retrofitting. Also, the sleeve tube and horn of FIG. 1 are removed and discarded. A folding damper assembly 52 includes foldable brace members 54 and a damper assembly 56 mounted thereto. These components are shown in the folded configuration at the left of FIG. 6. In the folded state, these components can be inserted into the opening 58 in the existing framework which supported the removed components. Once inside the frame, the damper assembly is unfolded, and frame brace members 54 (comprising vertical member 54*a*, horizontal member 54*b* and diagonal member 54*c*) lock into place and the bottom portion 54*b* is welded (for example) into place. The pivoting interconnection of the components thus provide the ability for the damper 56 to move between the upper open position and the lower closed position (both positions are illustrated in FIG. 6.). It will be observed that the damper assembly includes an elongate cam slot 60 therein that angles upwardly slightly at a rearward portion thereof.

Figure 7:
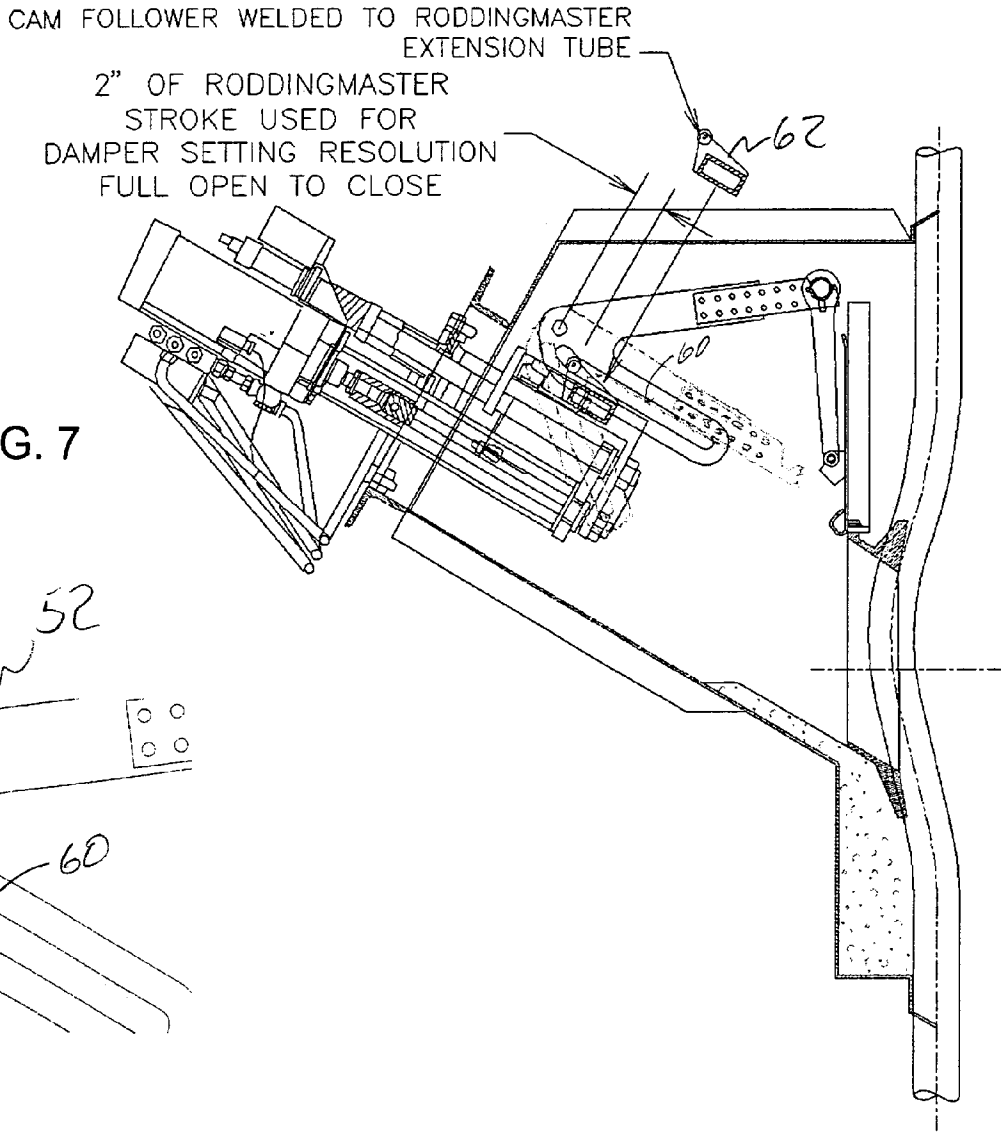
FIGS. 7, 7A comprise a side view of an intermediate point in the installation of the device, 7A being an enlarged view of the cam follower.
Figure 7A:
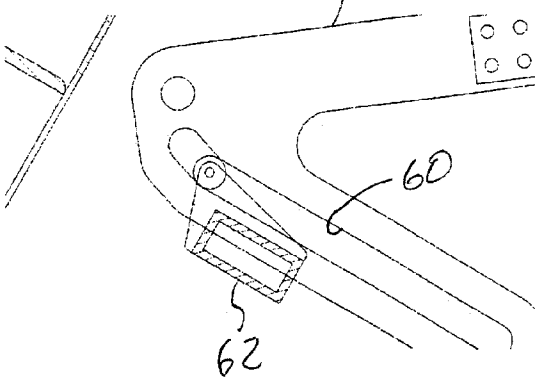

Referring now to FIG. 7, which illustrates an intermediate configuration during the installation of the device according to the invention, a cam follower 62 is mounted to the extension tube portion of the Roddingmaster actuation device (which is shown remounted to its support frame). The cam follower engages the cam slot, whereupon movement of the extension tube portion of the Roddingmaster device causes the damper assembly to open and close, thereby enabling adjustment of the amount that the air port is opened. The angled configuration of the cam slot rear portion allows the damper to open or close to a desired degree by controlling the amount of extension of the extension tube. An exemplary amount of extension provided by the extension tube is 12 inches, and, given the configuration of the cam slot, suitably, 2 inches of the extension stroke provides control of the damper anywhere between fully closed or fully open. The remaining 10 inches of extension leave the damper in the fully open position, and are then used to operate the cleaning device as discussed hereinbelow. FIG. 7A shows an enlarged view of the cam follower 62 and its interaction with the cam slot 60.

Figure 8:
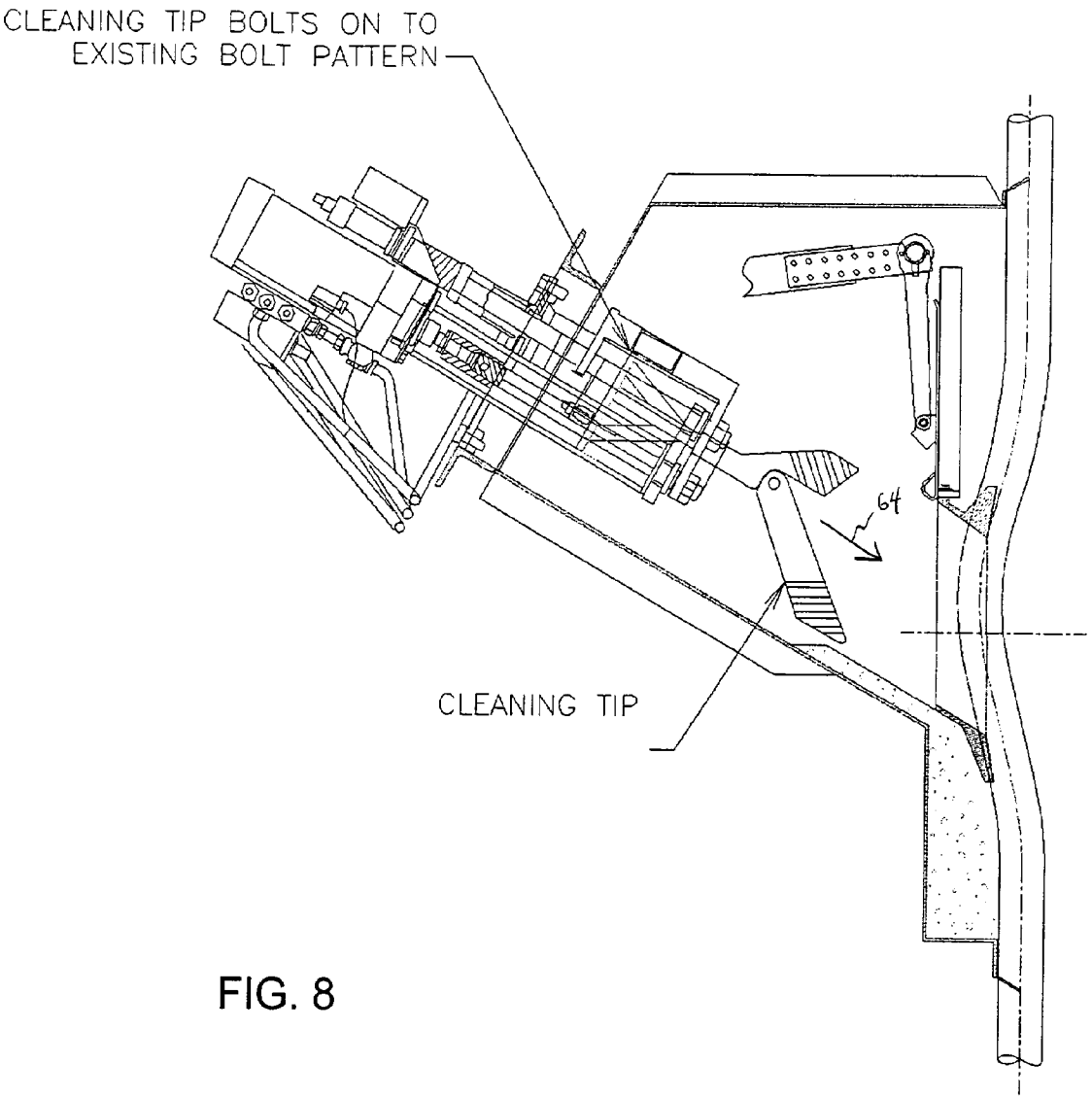
FIG. 8 is a view of the finally installed damper assembly and drop jaw tip as attached to a cleaning actuator of the prior art.

FIG. 8 is a view of the installed damper assembly and drop jaw tip as attached to a cleaning actuator of the prior art. A portion of the arm 52 is removed in this view for clarity. A drop jaw tip cleaner as described in connection with FIGS. 3 and 4 is suitably mounted to the extension tube of the Roddingmaster device, being boltable via the existing bolt pattern on the device.

Now, in operation, the extension tube of the Roddingmaster device is set somewhere within the last 2 inches of its outward stroke, so that the damper blade is set to the desired degree of closing. When a cleaning cycle is to be performed, the extension tube is caused to extend (in the direction of arrow 64). In the first 2 inches of extension, the cam follower will ride in the cam slot, causing the damper blade to retract to the fully open position (which is the position illustrated in FIG. 8). The remaining extension of the extension tube will drive the cleaning tip into the air port opening, which will result in cleaning of the air port. Then, on retraction of the extension tube, the drop jaw tip will collapse as in FIG. 4, enabling removal of the cleaning tip without it getting caught on the air port. The extension tube is then retracted to the desired position to result in the damper blade moving down to the position preferred by the operation of the boiler.

Other variations over the embodiment that has been described are also possible. For example, while the tip is illustrated as using a substantially vertical movement, horizontal or diagonal moving components can be used. Two or more movable portions can be used instead of the single hinged moving component of the tip.

Therefore, in accordance with the invention, and improved ability to control the air port air is provided while providing an improved cleaning tip to clean the air port. The cleaning tip may suitably be retrofitted to an existing air port cleaning device such as a Roddingmaster brand device, or may suitably be employed with an air port cleaning device manufactured by Anthony-Ross Company, or the like. The cleaning tip is advantageous in that on the insertion stroke it presents a larger area of cleaning action, but on the withdrawal stroke, it is collapsible to a small area to minimize the risk of getting hung up on the air port or air port casting.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A method for converting an air port cleaner device having an extensible sleeve cleaning member, comprising the steps of:

removing the sleeve cleaning member; and installing a cleaning member that is capable of presenting a larger overall cleaning area on an insertion stroke and a smaller overall area on a withdrawal stroke in place thereof, said cleaning member including a base portion and at least one movable portion, movable with respect to said base portion, said movable portion comprising a tip portion, said tip portion having a forward end and a rearward end relative to an insertion direction, said tip portion being rotatably mounted to said base portion adjacent said rearward end to enable partial rotation thereof, said movable portion including an engaging portion at said rearward end, said base portion comprising a seat portion in an area adjacent to said rearward end of said tip portion, wherein on an insertion of said member into the air port in a forward insertion direction, said tip portion rotates in a rearward direction until said engaging portion seats against said seat portion to lock the movable portion against further movement in said rearward direction.

2. The method according to claim 1, further comprising the step of installing an air port casting on the air port.

3. The method according to claim 1, further comprising the step of installing an air port damper mechanism.

4. The method according to claim 3, wherein said step of installing an air port damper mechanism comprises installing the damper mechanism such that a first portion of an extension stroke of a cleaning actuator is adapted to control the extent to which the damper mechanism covers the air port.

5. The method according to claim 4, wherein said damper mechanism is operatively engaged with said actuator via a cam follower mechanism.

6. A cleaning tip for cleaning air ports, or smelt spouts, comprising:

an insertion member adapted for insertion into the air port or smelt spout to be cleaned, that is capable of presenting a larger overall cleaning area on an insertion stroke and a smaller overall area on a withdrawal stroke, a support member having said insertion member mounted thereto and for affecting insertion and retraction of said insertion member into the air port or smelt spout;

wherein said insertion member includes a fixed cleaning tip portion fixedly mounted relative to said support member and at least one movable cleaning tip portion, movable with respect to said fixed cleaning tip portion, and wherein said movable cleaning tip portion tip portion has a forward end and a rearward end relative to an insertion direction, said movable cleaning tip portion rotatably mounted with said fixed cleaning tip portion adjacent said rearward end to enable partial rotation thereof, said movable cleaning tip portion including an engaging portion at said rearward end, said fixed cleaning tip portion comprising a seat portion in an area adjacent to said rearward end of said movable cleaning tip portion, wherein on an insertion of said member into the air port or smelt spout in a forward insertion direction, said movable cleaning tip portion rotates in a rearward direction until said engaging portion seats against said seat portion to lock the movable portion against further movement in said rearward direction.

7. The cleaning tip according to claim 6, wherein the movable cleaning tip portion comprises a drop tip.

8. The cleaning tip according to claim 6, wherein said insertion member includes plural said movable cleaning tip portions.

9. The cleaning tip according to claim 6, wherein said at least one movable cleaning tip portion is mounted to said fixed cleaning tip portion via a pivot point, to move between a wider configuration and a narrower configuration.

10. A device for cleaning a part of a recovery boiler, comprising:

an actuating device for inserting and removing an insertion member mounted thereto to the part being cleaned, wherein said insertion member comprises:

a fixed cleaning tip portion fixedly mounted relative to said actuating device and at least one movable cleaning tip portion, movable with respect to said fixed cleaning tip portion, and wherein said movable cleaning tip portion comprises a forward end and a rearward end relative to an insertion direction, to enable partial rotation thereof, said movable cleaning tip portion including an engaging portion at said rearward end, said fixed cleaning tip portion comprising a seat portion in an area adjacent to said rearward end of said movable cleaning tip portion, wherein on an actuation of said activation device for insertion of said insertion member into the air port or smelt spout in a forward insertion direction, said movable cleaning tip portion rotates in a rearward direction until said engaging portion seats against said seat portion to lock the movable portion against further movement in said rearward direction.

11. The device according to claim 10, wherein the movable cleaning tip portion of said insertion member comprises a drop tip.

12. The device according to claim 10, wherein said movable cleaning tip includes plural said movable cleaning tip portions.

13. The device according to claim 10, wherein said movable cleaning tip portion is pivotally cooperative with said fixed cleaning tip portion, to move between a wider configuration and a narrower configuration.

14. The device according to claim 10, wherein said recovery boiler includes an air port, further comprising a damper member for providing selectable damping of the air port.

15. The device according to claim 14, further comprising an engagement member for operatively connecting said damper member with said actuating device, whereby said damper is controlled by operation of said actuating device.

* * * * *